United States Patent [19]

Giulie et al.

[11] 4,187,630

[45] Feb. 12, 1980

[54] PICTURE FRAME

[76] Inventors: Joe D. Giulie; James E. Guilie, both of 1015 Corporation Way, Suite D, Palo Alto, Calif. 94300

[21] Appl. No.: 867,224

[22] Filed: Jan. 6, 1978

[51] Int. Cl.[2] ..... G09F 1/12

[52] U.S. Cl. ..... 40/156; 40/152

[58] Field of Search ..... 40/152, 152.1, 156, 40/155, 209, 124.1

[56] References Cited

U.S. PATENT DOCUMENTS

| | | | |
|---|---|---|---|
| 2,993,290 | 7/1961 | Bell et al. | 40/156 X |
| 3,478,997 | 11/1969 | Goss | 40/152 |
| 3,924,307 | 12/1975 | Tate | 40/156 X |
| 4,078,326 | 3/1978 | Reim | 40/152.1 |

FOREIGN PATENT DOCUMENTS

| | | | |
|---|---|---|---|
| 2131357 | 1/1973 | Fed. Rep. of Germany | 40/152 |

*Primary Examiner*—John F. Pitrelli
*Attorney, Agent, or Firm*—Robert G. Slick

[57] ABSTRACT

A frame for pictures and the like is provided having a U-shaped edge member including a pair of arms extending downwardly from a bight and having an inwardly extending member on one of the arms. The picture is held in place by means of a sheet of a bendable, stiff material which is folded over near a marginal edge with the fold line resting against the bight and the terminal edge locked against the inwardly extending member.

3 Claims, 3 Drawing Figures

PICTURE FRAME

SUMMARY OF THE INVENTION

Many frames have been proposed for pictures and mirrors but all of them have been relatively expensive and have involved a substantial amount of mechanical manipulation, sometimes requiring tools, for assembly.

The frame element of the present invention is made of a simple, plastic extrusion generally in the form of a U. The U has two arms extending outwardly from the bight and one of the arms has a member extending inwardly in the direction of the opposite arm. A sheet of a stiff, bendable material is employed to lock the picture in place and the fold line of the bendable member rests against the bight while the terminal edge rests against the extension. Thus, it is extremely easy to assemble the picture into the frame element.

For most purposes, glass would be employed as well as a separate picture, with the bendable element serving as a mat or background on which the picture is displayed. However, it is not necessary to employ a separate glass or picture and the bendable element itself can be in the form of a picture.

In accordance with a preferred embodiment of the invention, one of the arms of the U extends beyond the inwardly directed extension and has a plurality of notches therein which serve as a hanger for the picture. Since the arm of the U having the extension is spaced somewhat from the stiff material which forms the backing, the head of a nail or hook easily fits between the edge of the frame and the backing material, making it extremely easy to hang the picture.

Various additional features and advantages of the invention will be brought out in the balance of the specification.

DESCRIPTION OF THE PREFERRED EMBODIMENTS

Figure 1:
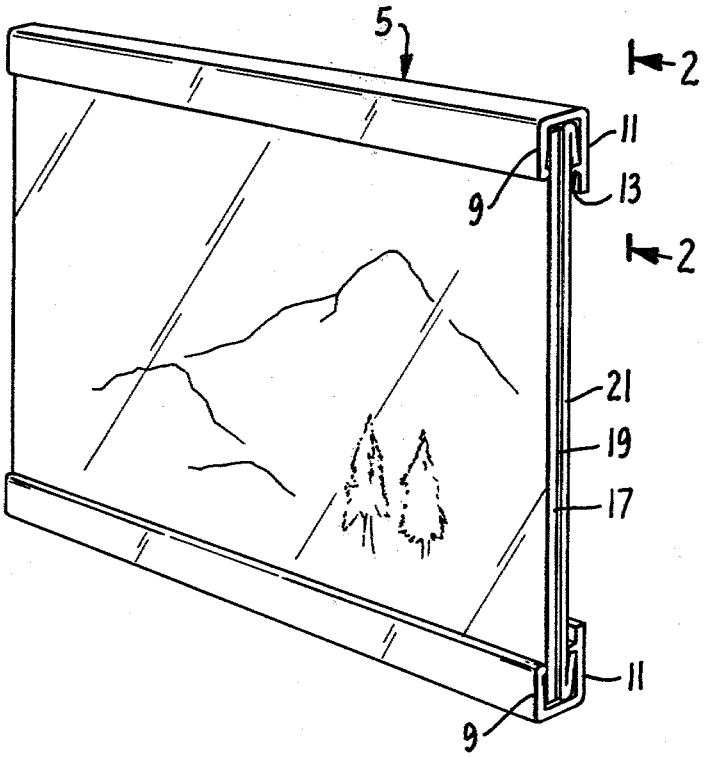
FIG. 1 is a perspective view of a picture with a frame embodying the present invention.

Referring now to the drawings by reference characters, the main frame element of the present invention consists of a U-shaped member generally designated 5 which is composed of a plastic extrusion having a bight 7 between two arms 9 and 11. Arm 11 has an inwardly directed member 13 and arm 9 preferably has a small inwardly directed bead 15. The bead 15 is not strictly necessary for the operation of the invention.

Figure 2:
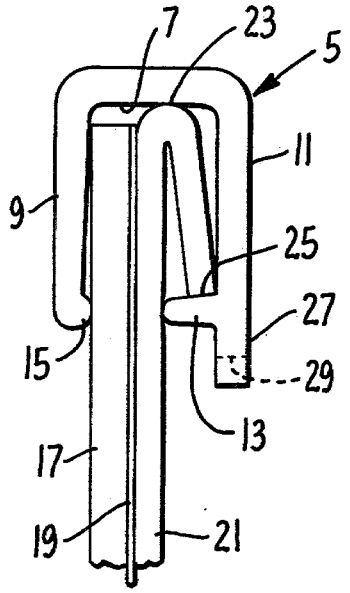
FIG. 2 is an enlarged section on the line 2—2 of FIG. 1.
Figure 3:
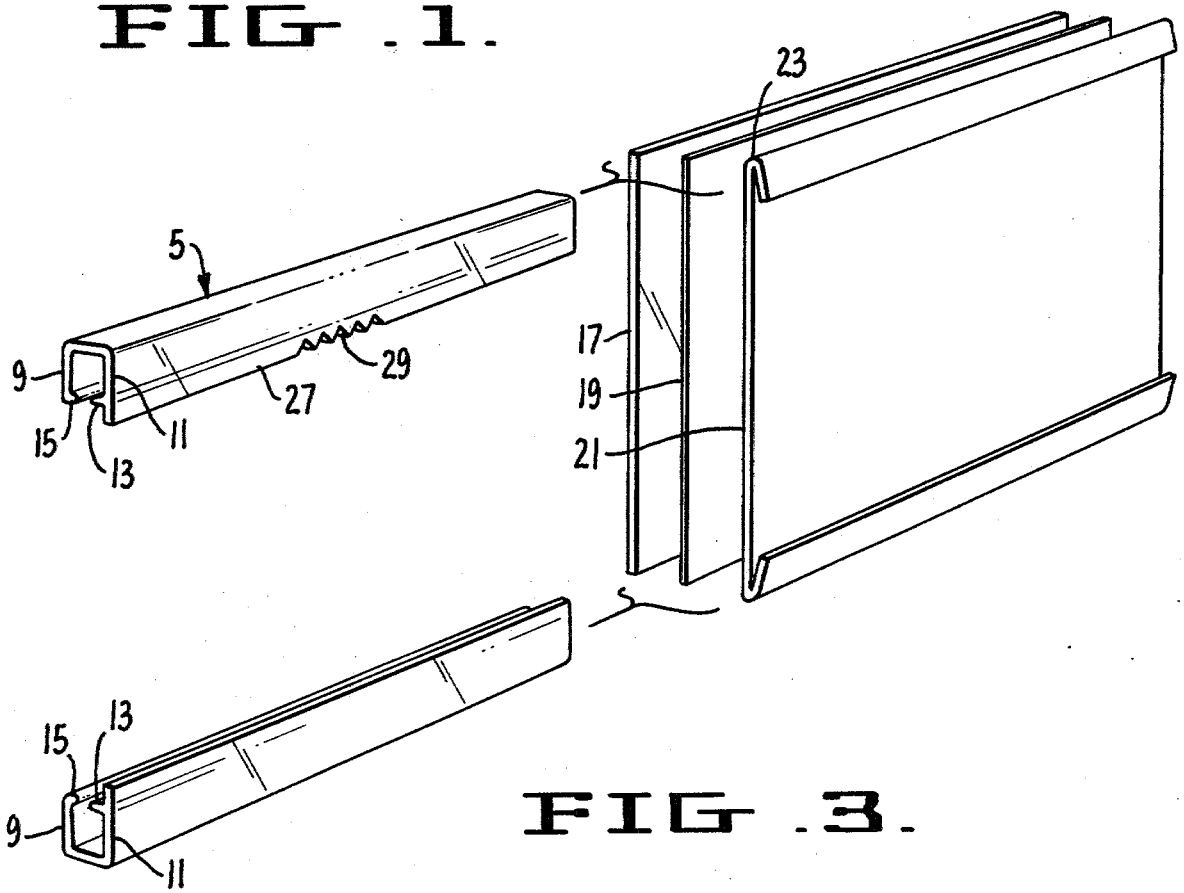
FIG. 3 is an exploded view of the picture and frame illustrating the method of assembly.

A typical picture includes a front cover glass 17, the picture proper 19, and a rear member 21 of a bendable, stiff material, typically cardboard. The member 21 is folded near one edge so that it has a fold line 23 and a terminal edge 25 which are parallel. To assemble the picture frame, it is only necessary to bend the member 21 along a line at proper distance from an edge, as is best seen in FIG. 2, so that the distance between the extension 13 and the bight 7 is equal to the folded over portion. Now as the picture is assembled, there is a natural springiness to the material 21 and it will tend to straighten out, locking the picture firmly in place between the bight and extension 25.

In accordance with the preferred embodiment of the invention, arm 11 is made longer than the arm 9 and extends downwardly beyond extension 13 as shown at 27. This downward extending portion 27 can have one or more notches 29 formed therein which provides a convenient method of hanging the picture. As is best seen in FIG. 2, there is a substantial amount of space between the members 11 and 21 so that a head of a nail or a hook can easily be put in this place, forming a convenient means of suspending the picture.

It has been assumed in the foregoing that the picture element would have a glass, the picture proper, and a stiff backing member 21. However, it is not necessary to employ the glass and the picture itself can form part of the backing member 21. Obviously the thickness of the backing member 21, or the combination of glass, picture and backing element, must be selected so that it forms a relatively tight fit between the arms 9 and the extension 25 on arm 11.

In the foregoing, only top and bottom frame members have been shown and this is for the reason that the frame of the present invention is an inexpensive one, particularly adapted for advertising signs, informal pictures and the like. Obviously, by mitering the ends, the same frame treatment could be employed on all four edges.

Although a specific embodiment has been described and illustrated, it is obvious that many variations can be made from the exact structure shown without departing from the spirit of this invention.

We claim:

1. A picture having a frame wherein a "U" shaped frame member forms the edge on a sheet of bendable, stiff material, said picture comprising in combination:

a. a "U" shaped edge member, b. said "U" having a pair of arms extending upwardly from a bight, c. an inwardly extending member on one of said arms spaced from said bight and extending toward, but terminating short of, the opposite arm, d. a sheet of bendable, stiff material, e. said sheet of material being folded parallel to a terminal edge to provide a fold line, f. said fold line resting against said bight, g. said terminal edge springing out from the main body of the sheet and resting against the corner formed between the inner side of said inwardly extending member and the arm of the "U" from which said member extends, h. whereby said sheet is locked in said "U" shaped edge member.

2. The structure of claim 1 wherein said picture includes a front glass member lying against said bight and lying against the arm of the "U" opposite said extension, a thin picture between said glass and said stiff material and wherein said stiff material forms a backing for said picture and locks the glass and picture into said frame.

3. The structure of claim 1 wherein one of said arms has a plurality of notches to provide a means for hanging the picture.

* * * * *